US006931962B2

(12) United States Patent
Maurer et al.

(10) Patent No.: US 6,931,962 B2
(45) Date of Patent: Aug. 23, 2005

(54) FOOT OR HAND OPERATED CONTROL

(75) Inventors: Rainer Maurer, Berlin (DE); Uwe Gillman, Berlin (DE); Michael Stoffers, Berlin (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/192,460

(22) Filed: Jul. 9, 2002

(65) Prior Publication Data

US 2003/0010147 A1 Jan. 16, 2003

(30) Foreign Application Priority Data

Jul. 10, 2001 (DE) ..... 101 33 492

(51) Int. Cl.[7] ..... G05G 1/00
(52) U.S. Cl. ..... 74/512; 74/560; 74/491
(58) Field of Search ..... 74/594.4, 512, 74/560, 473.3, 473.16, 478, 513, 514, 473.29, 604, 469, 491; 92/130 D

(56) References Cited

U.S. PATENT DOCUMENTS

| | | | | | |
|---|---|---|---|---|---|
| 2,042,202 | A | * | 5/1936 | Althouse | 477/216 |
| 2,280,859 | A | * | 4/1942 | Siesennop | 477/216 |
| 2,379,306 | A | * | 6/1945 | Larson et al. | 91/186 |
| 2,831,464 | A | * | 4/1958 | Lillquist | 91/167 R |
| 4,172,217 | A | * | 10/1979 | Miller | 200/86.5 |
| 4,250,768 | A | | 2/1981 | Hildebrecht | 74/512 |
| 4,597,307 | A | * | 7/1986 | Kawaguchi et al. | 74/512 |
| 4,875,008 | A | * | 10/1989 | Lorenzen | 324/207.21 |
| 4,887,701 | A | * | 12/1989 | Van Der Vliet | 477/210 |
| 5,133,225 | A | * | 7/1992 | Lundberg et al. | 74/560 |
| 5,180,925 | A | * | 1/1993 | Lieb | 307/114 |
| 5,242,337 | A | * | 9/1993 | Greenwood | 476/10 |
| 5,300,926 | A | * | 4/1994 | Stoeckl | 345/157 |
| 5,309,361 | A | | 5/1994 | Drott et al. | 364/403 |
| 5,423,231 | A | * | 6/1995 | Helfrich et al. | 74/561 |
| 5,535,642 | A | | 7/1996 | Moll | 74/561 |
| 5,583,407 | A | * | 12/1996 | Yamaguchi | 318/551 |
| 5,635,777 | A | | 6/1997 | Telymonde et al. | 307/119 |
| 5,794,490 | A | * | 8/1998 | Papenhagen et al. | 74/513 |
| 6,275,025 | B1 | * | 8/2001 | Wiese | 324/207.2 |
| 6,408,712 | B1 | | 6/2002 | Bolisetty et al. | 74/514 |

FOREIGN PATENT DOCUMENTS

| | | | |
|---|---|---|---|
| DE | DT2615237 | A1 | 10/1977 |
| DE | 4109658 | A1 | 9/1992 |
| DE | 4322310 | A1 | 1/1995 |
| DE | 19755098 | A1 | 6/1999 |
| DE | 29921943 | U1 | 8/2000 |
| EP | 0708006 | A1 | 4/1996 |
| GB | 2175375 | A | 11/1986 |
| GB | 2378235 | A | 2/2003 |
| JP | 11321621 | * | 12/1999 |
| WO | WO 01/44668 | A2 | 6/2001 |

* cited by examiner

*Primary Examiner*—William C. Joyce
*Assistant Examiner*—Julie K. Smith
(74) *Attorney, Agent, or Firm*—Roger C. Turner

(57) ABSTRACT

A control has a pivotal part with an operating surface that can be depressed by a person's foot or hand, with pivoting being sensed by a pivot sensor. A spring-operated mechanism urges the pivotal part toward an initial position while allowing it to pivot in both clockwise and counterclockwise directions from the initial position, the sensor indicating the amount of pivoting in either direction from the initial position. A damping unit for limiting the speed of depression includes a cylinder that contains fluid and a plunger that is depressed by the pivotal part into the cylinder to displace the fluid.

3 Claims, 2 Drawing Sheets

FOOT OR HAND OPERATED CONTROL

CROSS-REFERENCE TO RELATED APPLICATION

Applicant claims priority from German patent application 10133492.3 filed Jul. 10, 2001.

BACKGROUND OF THE INVENTION

Machines such as vehicles are commonly operated by movement of pivotal parts such as foot-operated pedals or hand-operated levers. Such manually-operated pivotal parts are commonly spring biased to an initial position, depressable against a spring force from the initial position and releaseable to allow the spring to return the pivotal part to the initial position. In many cases it would be desirable if the same control could be operated to control other operations or another machine.

SUMMARY OF THE INVENTION

In accordance with one embodiment of the present invention, a control is provided for operation by a foot or hand limb, of the type which includes a pivotal housing part that pivots about a horizontal axis on a fixed housing part, a spring that urges the pivotal part toward an initial position, and a sensor arrangement that senses pivoting. The spring-operated mechanism allows the pivotal housing part to pivot continuously in both clockwise and counterclockwise directions about the axis from the initial position, and urges the pivotal housing part toward the initial position when pivoted in either direction. The sensor senses the degree of pivoting in either direction.

At least one damping unit includes a plunger with an end that moves within a cylinder containing fluid, the fluid preventing rapid movement of the plunger. A spring urges the plunger upward toward a position wherein it can be depressed when the pivotal housing part is pivoted in one direction. Two damping units are used, each resisting rapid pivoting of the pivotal housing part in a different direction.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
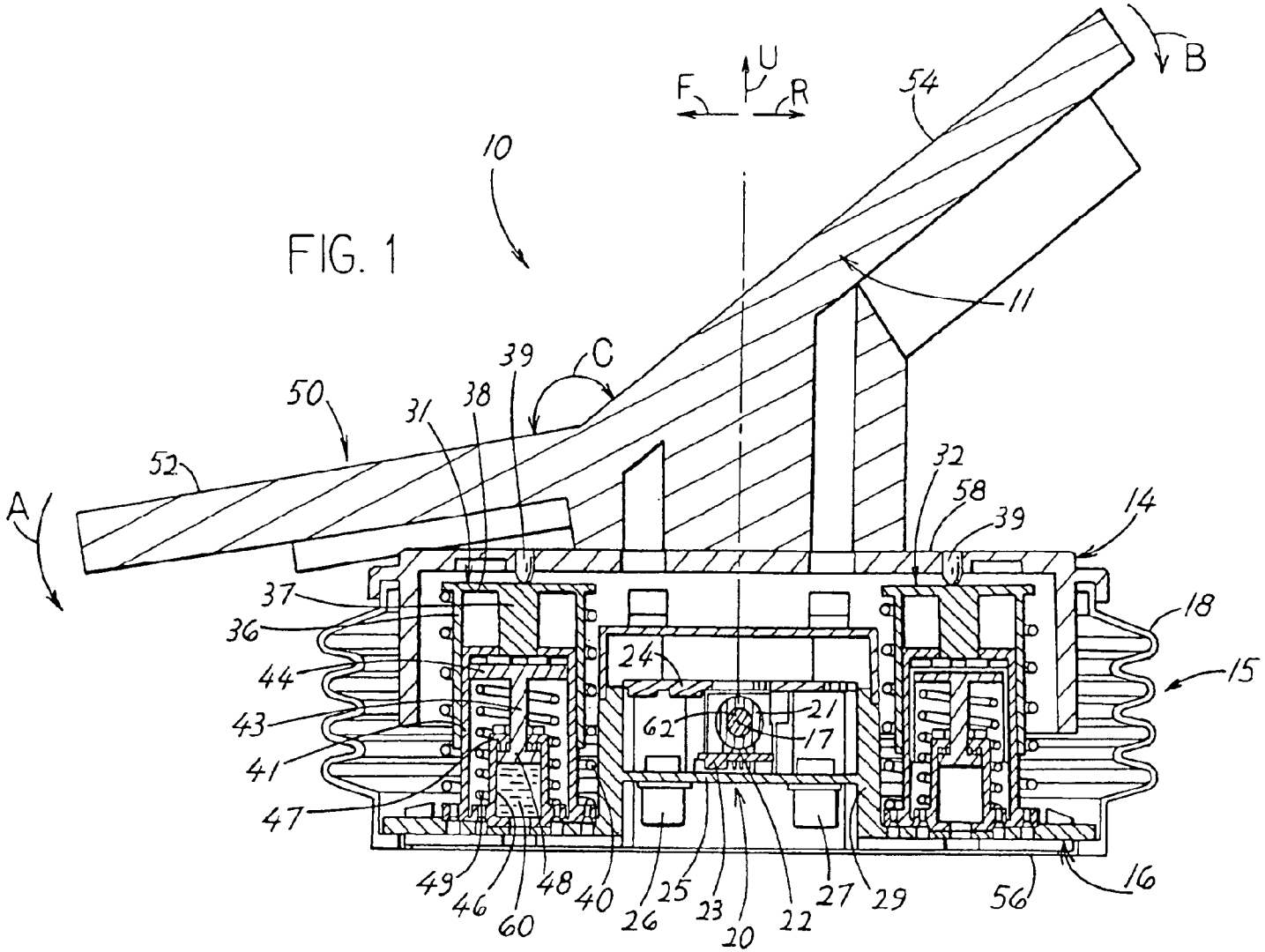
FIG. 1 is a sectional side view of a foot-operated control of the present invention.

FIG. 1 illustrates a control 10 with a housing 15 that includes a fixed housing part 16 and that includes a pivotal housing part 14 that can pivot about a laterally-extending horizontal axis 17 on the fixed housing part. The pivotal housing part includes a pedal or lever 11 with an operating surface 50 that includes front and rear portions 52, 54 spaced in forward and rearward directions F, R, with both surface portions facing largely upwardly U. The front portion 52 is angled at a forward-downward incline of about 10 degrees from the horizontal, the rear portion 54 is angled at a rearward-upward incline of about 35°, and there is an angle C of about 150° between the portions. The fixed and pivotal housing parts respectively include lower and upper plates with circular peripheries. A bellows 18 extends between the round peripheries of the upper and lower plates and seals the region between them. The bellows also provides some spring biasing that urges the pivotal housing part 14 toward the initial position illustrated wherein the upper plate 58 extends parallel to the lower plate 56.

The control includes a pivot sensor 20 that includes a permanent magnet 21 and a magnetic field sensor such as a Hall sensor unit 22. The Hall sensor unit 22, which includes two Hall sensors, is mounted on a sensor board 23 that is, in turn, mounted and connected to a printed circuit board 24 with electrical components thereon that process the output of the Hall sensor unit. Two plug connectors 26, 27 serve as terminals for connection to other circuitry. The particular control 10 is designed for controlling a vehicle and the outputs of the Hall sensors can be used to energize vehicle driving and/or steering motors. In FIG. 1, a frame 29 is mounted on the lower plate 56, with the sensors mounted within the frame on the circuit board.

The control includes a pair of damping units 31, 32 that respectively lie forward and rearward of the pivot axis. The two damping units are identical, and only one is described in detail. The damping unit 31 includes a first or upper cylinder 36 which is biased upwardly by a first spring 40. The upper cylinder is guided in vertical movement by a second cylinder 41 whose lower end is fixed to the lower plate 56. A pin 39 which is fixed to the upper plate 58, has a rounded end engaged with a cylinder cover 38. Thus, when the front operating surface 52 is depressed and causes the front end of the upper plate 58 to move downward, the pin 39 presses downward against the cylinder cover 38 to depress the cylinder 36 against the upward force of the spring 40.

A ram 37 extends downward from the cylinder cover and has a lower end that projects through a hole in the top of the first cylinder 41 and that bears against a ram plate 44. The ram plate is guided in vertical movement by the cylindrical inside of the second cylinder 41 and is connected through a second ram 43 to a plunger 48. The plunger moves within a damping chamber 46 that is filled with a fluid, with one example being a hydraulic fluid. The plunger 48 has a gap that allows flowthrough of the damping fluid during downward and upward movement of the plunger. The damping chamber 46 is fixed to the lower plate 56, and its upper end forms a fluid-tight seal with the second ram 43. A second spring 49 biases the ram plate 44 upwardly to its initial position.

When a downward force is applied to the operating surface front portion 52, the pedal 11 is pivoted counterclockwise in a direction A. In one example, counterclockwise A pivoting controls energy delivered to motors that advance a vehicle forward, while clockwise pivoting B applies a brake to stop the vehicle. This causes the pin 39 to depress the first ram 37 and the first ram to depress the second ram 43, causing the plunger 48 to move down through fluid 60 in the damping chamber. The fluid 60 resists rapid downward movement of the front end of the pivotal housing part. When the downward force on the operating surface front portion 52 is relieved, the first spring 41 rapidly moves the front portion of the pivotal housing part upward to the initial position shown in FIG. 1. The ram 43 slowly moves up to its initial position. A downward and forward movement against the operating surface rear portion 54 causes clockwise pivoting B of the pedal and downward movement of the rearward damping unit 32.

Pivoting of the pivotal housing part 14 causes pivoting of a shaft 62 that is fixed to the permanent magnet 21. As the permanent magnet turns, the magnetic field sensed by the Hall Sensor unit 22 changes, and the output of the Hall sensors indicate pivoting of the pedal. The Hall sensors also sense pivoting of the magnet when the pivotal housing part pivots in the direction B.

Figure 2:
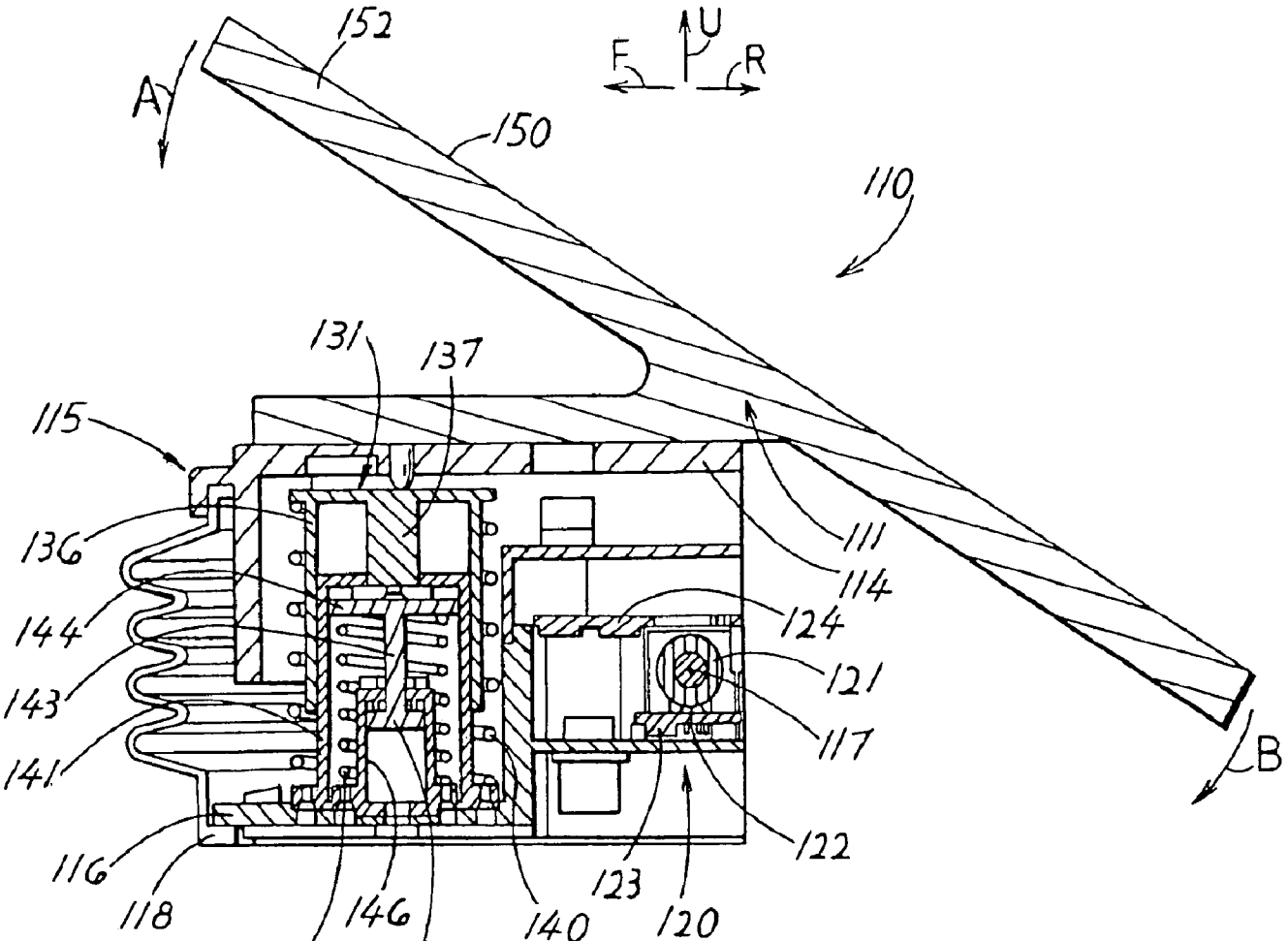
FIG. 2 is a sectional view of a foot-operated control of another embodiment of the invention.

FIG. 2 illustrates a control 110 of another embodiment of the invention. All parts of the control 110 that are similar to those of the control 10 of FIG. 1, have the same number, but with a "1" before the number. The control 110 of FIG. 2 has only one damping unit 131 which is positioned forward of the pivot axis 117. The operating pedal, or lever 111 can be pivoted in both directions of arrows A and B from the initial position shown in FIG. 2. The operating lever 110 is modified in that all of its operating surface 150 is planar and faces in an upward U and rearward R incline. The lever 111 is normally operated by depressing a front portion 152 of the lever, whose depression is resisted by the damping unit 131, but which rapidly springs back to the initial position shown in FIG. 2 when the depressing force applied to the forward portion 52 is relieved.

Thus the invention provides a control for manual operation by a foot or hand appendage of a person to control a machine, which includes a pivotal housing part that pivots about an axis on a fixed housing part and which has an operating surface with operating surface portions that can be depressed by the person. A spring operated mechanism which is preferably part of a damping unit, urges the pivotal housing part towards an initial position, but allows it to pivot in both clockwise and counterclockwise directions from the initial position, and a sensor indicates pivoting in either direction. The damping unit includes a plunger that can be depressed by the pivotal housing part, the plunger having a part lying in a cylinder that contains a fluid that resists rapid depressing of the plunger. However, springs of the damping unit cause rapid upward movement of a depressed end of the pivotal housing part.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A control for manual operation to control a machine, comprising:

a fixed housing part;

a pivotal housing part that is pivotal about an axis on the fixed housing part and that has a surface for manual depression to pivot the pivotal housing part;

a pivot sensor arrangement that generates an electrical signal indicating the angle of pivoting of said pivotal housing part;

a spring-operated mechanism that urges said pivotal housing part toward an initial position;

said spring-operated mechanism allows said pivotal housing part to pivot continuously in both clockwise and counter-clockwise directions by a plurality of degrees about said axis, from said initial position, and urges said pivotal housing part toward said initial position when pivoted in either of said directions from said initial position, and said pivot sensor arrangement indicates the amount of pivoting in either of said directions from said initial position;

said spring operated mechanism includes a damping device that includes a cylinder containing a fluid, a plunger slideable in said cylinder, a first spring that urges said plunger upwardly, a ram that lies against said plunger to depress said plunger, and a second spring that urges said ram upwardly, said pivoting housing part being engaged with said ram to depress it so said ram depresses said plunger, but said ram being free to move up and away from said plunger under the force of said second spring to rapidly return said pivoting housing part to said initial position.

2. A control for manual operation by a person, which includes a fixed housing part, a pivotal housing part pivotally connected about an axis to the fixed housing part, and a pivot sensor that senses the angle of pivoting of the pivotal housing part, including:

a damping unit that includes plunger and cylinder elements lying between said pivotal and fixed housing parts, and a spring, said damping unit being expandable and contractible in length, said cylinder element containing a fluid that resists rapid movement of said plunger, and said spring urges the plunger toward a plunger first position that expands the length of said damping device to resist pivoting of the pivotal housing part away from said initial position;

said damping unit includes an upper element that has a ram with a lower end that lies against said plunger to depress said plunger, and a second spring element that urges said upper element upwardly, said pivotal housing part being engaged with said upper element to depress it so said ram depresses said plunger, but said upper element being free to move up away from said plunger to rapidly move said pivotal housing part toward said initial position.

3. A control for manual operation by a person, which includes a fixed housing part, a pivotal housing part pivotally connected about an axis to the fixed housing part, and a pivot sensor that senses the angle of pivoting of the pivotal housing part, wherein:

said pivotal housing part has an operating surface with front and rear portions each facing largely upwardly and lying respectively forward and rearward of said axis to pivot said pivotal housing part in opposite directions as different ones of said surface portions are depressed; and including a pair of damping units, said damping units located on opposite sides of said axis and each coupled to said pivotal housing part to resist rapid pivoting of said pivotal housing part away from said initial position, each damping unit including a plunger a closed cylinder containing a fixed amount of fluid that resists rapid movement of the plunger, and a spring that urges the plunger toward an initial position.

* * * * *